US011536548B1

(12) United States Patent
Hanc et al.

(10) Patent No.: US 11,536,548 B1
(45) Date of Patent: Dec. 27, 2022

(54) TRANSFER RING TURNBUCKLE

(71) Applicant: U.S. Government as Represented by the Secretary of the Army, Dover, NJ (US)

(72) Inventors: Ryan Hanc, Mine Hill, IN (US); Brian Peterson, Rockaway, NJ (US)

(73) Assignee: United States of America as Represented by the Secretary of the Army, Washington, DC (US)

( * ) Notice: Subject to any disclaimer, the term of this patent is extended or adjusted under 35 U.S.C. 154(b) by 15 days.

(21) Appl. No.: 17/206,353

(22) Filed: Mar. 19, 2021

(51) Int. Cl.
*F42B 10/46* (2006.01)
*F42B 33/00* (2006.01)

(52) U.S. Cl.
CPC ..... *F42B 33/001* (2013.01); *F42B 10/46* (2013.01)

(58) Field of Classification Search
CPC ..... F42B 33/001; F42B 10/46; F42B 12/00; F42B 30/08; F16L 15/006; F16L 15/007; F16L 15/008
USPC ..... 102/517
See application file for complete search history.

(56) References Cited

U.S. PATENT DOCUMENTS

| | | | | |
|---|---|---|---|---|
| 3,454,293 | A | 7/1969 | Howlett | |
| 5,474,334 | A | 12/1995 | Eppink | |
| 9,816,797 | B1 | 11/2017 | Burnett | |
| 11,131,407 | B1 * | 9/2021 | Dannemann | F16L 15/08 |
| 2019/0249966 | A1 * | 8/2019 | Rice | F16B 7/182 |

* cited by examiner

*Primary Examiner* — Jonathan C Weber
(74) *Attorney, Agent, or Firm* — John P. DiScala

(57) ABSTRACT

A projectile enables axial assembly and precise angular alignment of cylindrical or ogival sections of the projectile without interfering with internal parts spanning those sections. The projectile includes a turnbuckle design that minimizes Outer Mold Line (OML) transitions and maintains structural integrity. Advantageously, the turnbuckle allows surface mounted antennas and internal electronics to span structural sections of the projectile. The minimal OML produces less turbulence and drag. Finally, the turnbuckle is structurally robust for gun launched applications.

13 Claims, 13 Drawing Sheets

TRANSFER RING TURNBUCKLE

STATEMENT OF GOVERNMENT INTEREST

The inventions described herein may be manufactured, used and licensed by or for the United States Government.

FIELD OF THE INVENTION

The invention relates in general to projectiles and in particular to assembled projectiles.

BACKGROUND OF THE INVENTION

An increase in the development of smart munitions has driven the necessity for angular alignment and axial assembly methods that do not interfere with internal cable routing or antennae wires in these munitions. For example, such smart munitions typically include internal features such as surface mount antennas, internal electronics and associated wiring and connectors. Accordingly, a growing need has surfaced for an efficient method of attachment between two cylindrical or ogive sections of a projectile such that features that span between the two sections are not twisted during assembly.

While there are several conventional methods of assembly, none are suitable for this purpose. A flanged attachment with bolts axially aligned with the centerline of the projectile is one known solution. However, this method requires a secondary cover to keep a smooth outer mold line and maintain aerodynamic properties which increases both the size and weight of the projectile.

Another method, the use of a captive collar, employs a configuration in which each half of the adjoining sections is externally threaded with left handed threads on one side and right handed threads on the other. The collar is a one piece ring half of which is internally threaded with matching left handed threads and the other half with matching right handed threads. Upon engaging both halves of the adjoining sections, the threads pull the adjoining pieces together. However, there is a downside to this approach as the collar ultimately leaves small gaps between itself and the adjoining pieces. This breaks the Outer Mold Line (OML) of the projectile and poses a problem for projectiles that undergo high velocity aerothermal heating as the gaps will trip turbulent boundary layer effects.

Another issue with this method is the flexure of the collar under loads that attempt to pull the joint apart. Since the collar is the outermost member, as the threads attempt to pull apart axially, the collar dilates outwards, generating bending stresses in the collar and thus the collar must be sized appropriately to remain structurally sound.

A need exists for a projectile that enables axial assembly and precise angular alignment that also minimizes Outer Mold Line (OML) transition and maintains structural integrity.

SUMMARY OF INVENTION

One aspect of the invention is a projectile comprising a fore portion, an aft portion and a threaded module positioned between the fore portion and the aft portion. The fore portion has a threaded portion of a first handedness. The aft portion has a threaded portion of a second handedness. The threaded module further comprises a cylinder, a torque ring coaxial with and partially surrounding the cylinder and one or more torque pins. The cylinder further comprises a first threaded portion of a first handedness for mating with the fore portion and a second threaded portion of a second handedness for mating with the aft portion. The first threaded portion and the second threaded portion are diametrically opposed from each other at opposing ends of the cylinder. The cylinder further comprises one or more radial slots positioned between the first threaded portion and the second threaded portion. The torque ring has a top surface in contact with a bottom surface of the fore portion and a bottom surface in contact with a top surface of the aft portion. The torque ring further comprises one or more holes, each corresponding to the one or more radial slots of the cylinder. The one or more torque pins are sized and dimensioned to be inserted through the one or more holes and radial slots.

Another aspect of the invention is a projectile comprising a fore portion, an aft portion and a threaded module positioned between the fore portion and the aft portion. The fore portion has a threaded portion of a first handedness. The aft portion has a threaded portion of a second handedness. The threaded module further comprises a cylinder and a torque ring coaxial. The cylinder further comprises a first threaded portion of a first handedness for mating with the fore portion and a second threaded portion of a second handedness for mating with the aft portion. The first threaded portion and the second threaded portion are diametrically opposed from each other at opposing ends of the cylinder. The cylinder further comprises one or more torque pins extending radially outward and positioned between the first threaded portion and the second threaded portion. The torque ring has a top surface in contact with a bottom surface of the fore portion and a bottom surface in contact with a top surface of the aft portion. The torque ring further comprises one or more axial slots.

Still another aspect of the invention is a method for assembling a projectile. The method comprises the steps of: providing a fore portion having a threaded portion of a first handedness, an aft portion having a threaded portion of a second handedness, a cylinder further comprising a first threaded portion of a first handedness and a second threaded portion of a second handedness, said first threaded portion and second threaded portion diametrically opposed from each other at opposing ends of the cylinder and one or more radial slots positioned between the first threaded portion and the second threaded portion, a torque ring further comprising one or more holes; positioning a torque ring around a center portion of a cylinder such that the one or more holes defined by the torque ring are aligned with the one or more radial slots defined by the cylinder; inserting a torque pin through each of the aligned pairs of holes and radial slots; simultaneously engaging the first threaded portion of with the fore portion of the projectile and the second threaded portion with the aft portion of the projectile; rotating the cylinder and torque ring thereby drawing the fore portion and the aft portion together without rotating the fore portion and the aft portion; and bottoming out the fore portion and the aft portion on the torque ring.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A projectile enables axial assembly and precise angular alignment of cylindrical or ogival sections of the projectile without interfering with internal parts spanning those sections. The projectile includes a turnbuckle design that minimizes Outer Mold Line (OML) transitions and maintains structural integrity.

Advantageously, the turnbuckle allows surface mounted antennas and internal electronics to span structural sections of the projectile. The minimal OML disturbances produce less turbulence and drag. Finally, the turnbuckle is structurally robust for gun launched applications.

Figure 1:
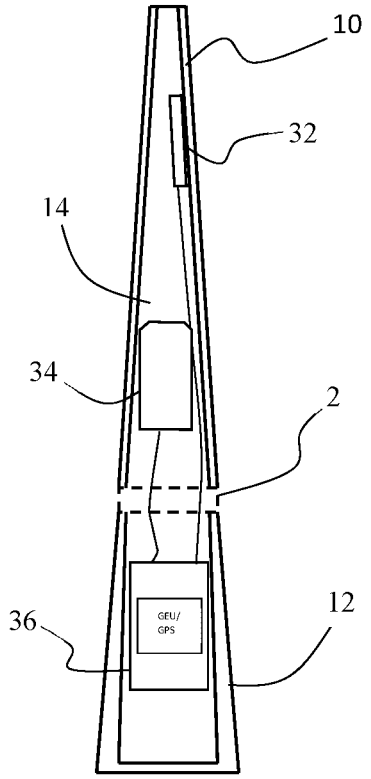
FIG. 1 is a cross-sectional view of a portion of projectile, according to one illustrative embodiment.

FIG. 1 is a cross-sectional view of a portion of projectile, according to one illustrative embodiment. An artillery projectile comprises multiple structural sections, including a fore portion 10, an aft portion 12 and a threaded module 2 defining an interior volume 14. The interior volume 14 houses internal electronics which span the structural sections. For example, the projectile includes a surface mount antenna 32, an electronic safe and arm device (ESAD) 34 and the Guidance Electronics Unit (GEU) and global position system module (GPS) 36.

The projectile is shown and described throughout in the context of an artillery projectile. For example, the projectile may be an artillery projectile for an 85 mm, 105 mm or 155 mm artillery system. Those skilled in the art will recognize that the turnbuckle and associated methods are not limited to artillery projectiles. The system and methods described herein may be employed on other military projectiles, such as mortars and rockets, and other non-military projectiles such as projectiles employed in civilian space operations. More broadly, the turnbuckle may be employed in any application in which two cylindrical sections must be axially assembled and angularly aligned and without interfering with internal parts spanning those sections.

Figure 2:
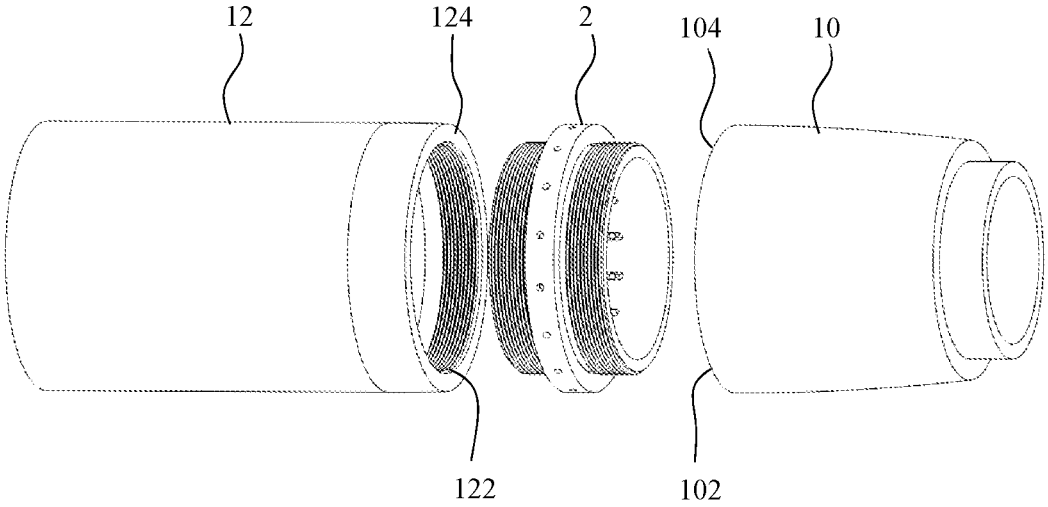
FIG. 2 is an exploded view of a portion of a projectile, according to one illustrative embodiment.

FIG. 2 is an exploded view of a portion of a projectile, according to one illustrative embodiment. The projectile further comprises a fore portion 10 and an aft portion 12 which must be axially assembled. A portion 102, 122 of the interior surfaces of both the fore portion 10 and the aft portion 12, proximate the threaded module 2, is threaded. The fore portion 10 comprises a thread of a first handedness and the aft portion 12 comprises a thread of a second handedness. The first handedness and the second handedness are opposite in direction. For example, the fore portion 10 may comprise a left threaded portion and the aft portion 12 a right threaded portion or vice versa.

Positioned between the fore portion 10 and the aft portion 12 is a threaded module 2. The fore portion 10 and aft portion 12 are joined via the threaded module 2. When assembled, the fore portion 10 and the aft portion 12 are connected to the threaded module 2 at the threaded portions 102, 122. A top surface 124 of the aft portion 12 and a bottom surface 104 of the fore portion 10 are in contact with the threaded module 2 such that the OML between each portion 10, 12 and the threaded module 2 is uniform.

Figure 3:
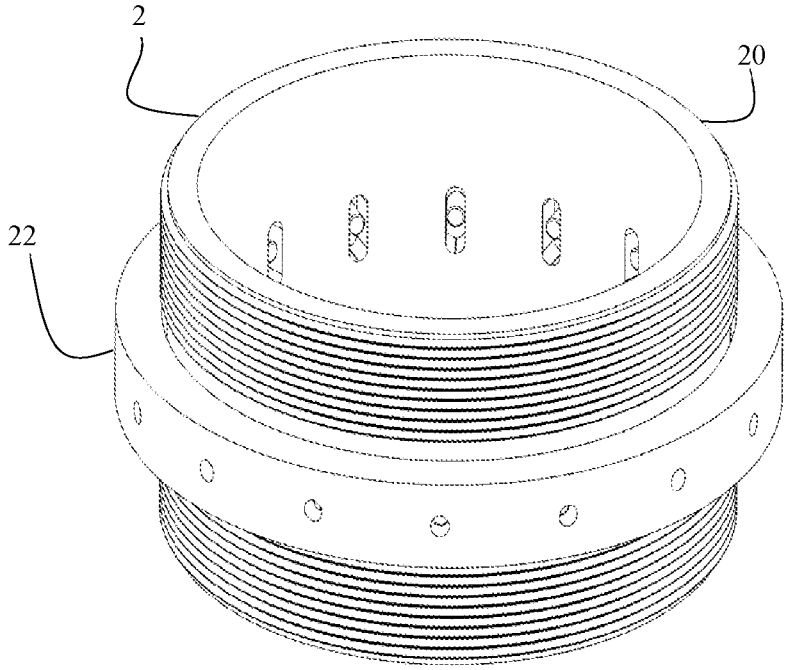
FIG. 3 is a perspective view of a threaded module, according to an illustrative embodiment.
Figure 4:
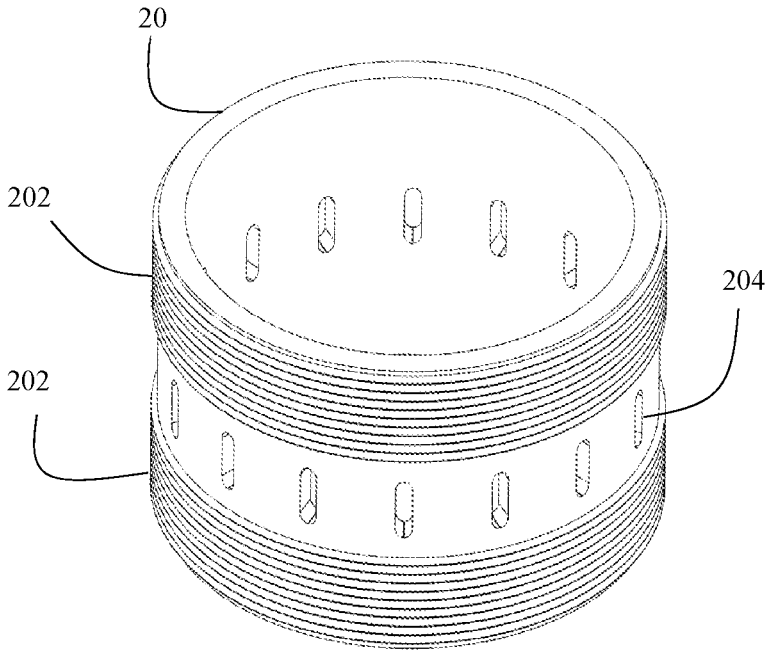
FIG. 4 is a perspective view of a cylinder, according to an illustrative embodiment.
Figure 5:
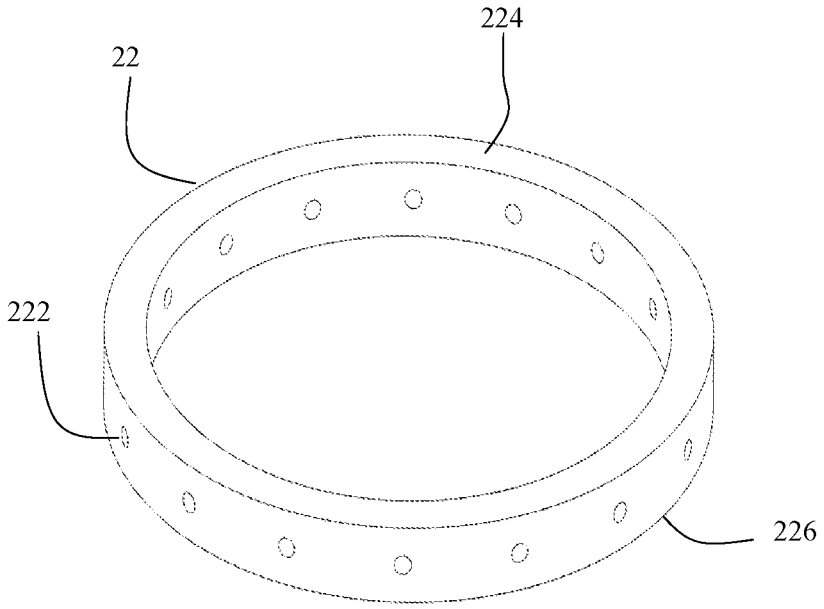
FIG. 5 is a perspective view of a torque ring, according to an illustrative embodiment.
Figure 6:
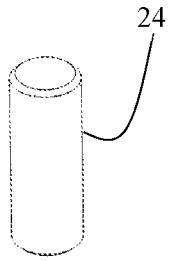
FIG. 6 is a perspective view of a torque pin, according to an illustrative embodiment.

FIG. 3 is a perspective view of a threaded module, according to an illustrative embodiment. FIG. 4 is a perspective view of a cylinder, according to an illustrative embodiment. FIG. 5 is a perspective view of a torque ring, according to an illustrative embodiment. FIG. 6 is a perspective view of a torque pin, according to an illustrative embodiment.

The threaded module 2 further comprises a cylinder 20, a torque ring 22 and one or more torque pins 24. The threaded module 2 is built around the cylinder 20. The cylinder 20 further comprises a threaded portion at opposing ends of the cylinder 20. The threaded portions of the cylinder 20 correspond to the threaded portions of the aft portion 12 and the fore portion 10, respectively. The threaded module 2 defines one or more radial slots 204 arranged radially around the center of the cylinder 20. The radial slots 204 are shaped to allow inserted torque pins 24 to slide back and forth along the principal axis of the cylinder 20 to allow for tolerances in manufacturing.

The module is assembled by positioning the torque ring 22 about the center of the threaded cylinder 20 such that one or more holes 222 defined by the torque ring 22 are aligned with the one or more radial slots 204 of the cylinder 20. The torque pins 24 are inserted through both the holes 222 and the radial slots 204.

Figure 7:
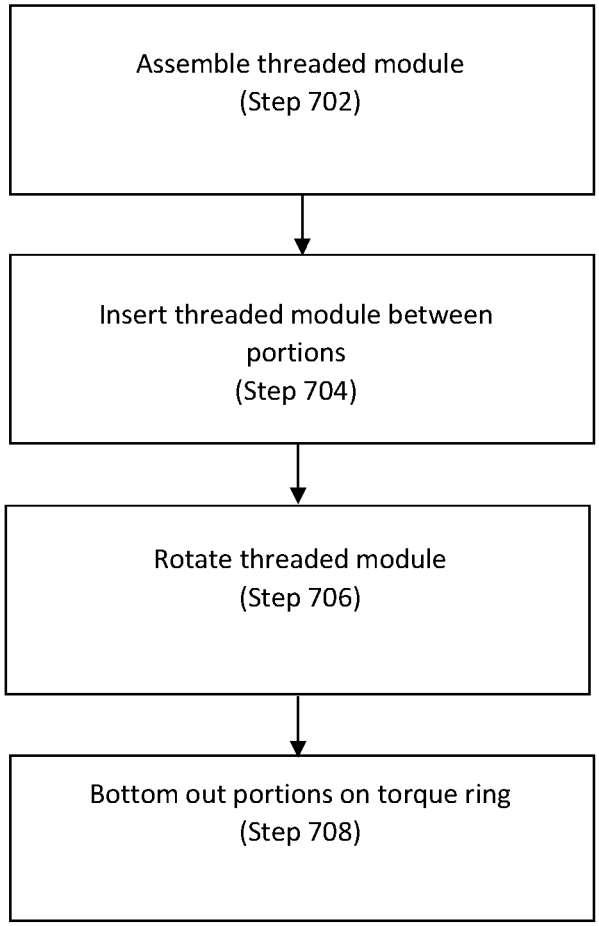
FIG. 7 is a flowchart illustrating a method of assembling a projectile, according to an illustrative embodiment.

FIG. 7 is a flowchart illustrating a method of assembling a projectile, according to an illustrative embodiment. In step 702, the threaded module 2 is assembled by aligning the torque ring 22 around the cylinder 20 and inserting the one or more torque pins 24 through the aligned holes 222 in the torque ring 22 and radial slots 204 in the cylinder 20.

In step 704, the threaded module 2 is inserted between the aft portion 12 and the fore portion 10 such that the threads on threaded module 2 are engaged with the threads on the aft portion 12 and the fore portion 10.

In step 706, the threaded module 2 is rotated thereby drawing the adjoining pieces together with the fore portion 10 translating downward toward the threaded module 2 and the aft portion 12 translating upward toward the threaded module 2. In one embodiment, a spanner is used to rotate the threaded module 2.

In step 708, a bottom surface of the fore portion 10 and a top surface of the aft portion 12 bottom out on the torque ring 22. Friction between the contacting surfaces overcomes the torque applied to the torque ring 22 and hold the pieces together via tension of the inner cylinder. Any manufacturing tolerances in sealing the outer mold line into a smooth surface are negated by allowing the torque ring 22 to move axially relative to the threaded cylinder 20, such that compression of the adjoining piece surfaces are the only restriction on the axial motion of the torque ring 22.

Figure 8:
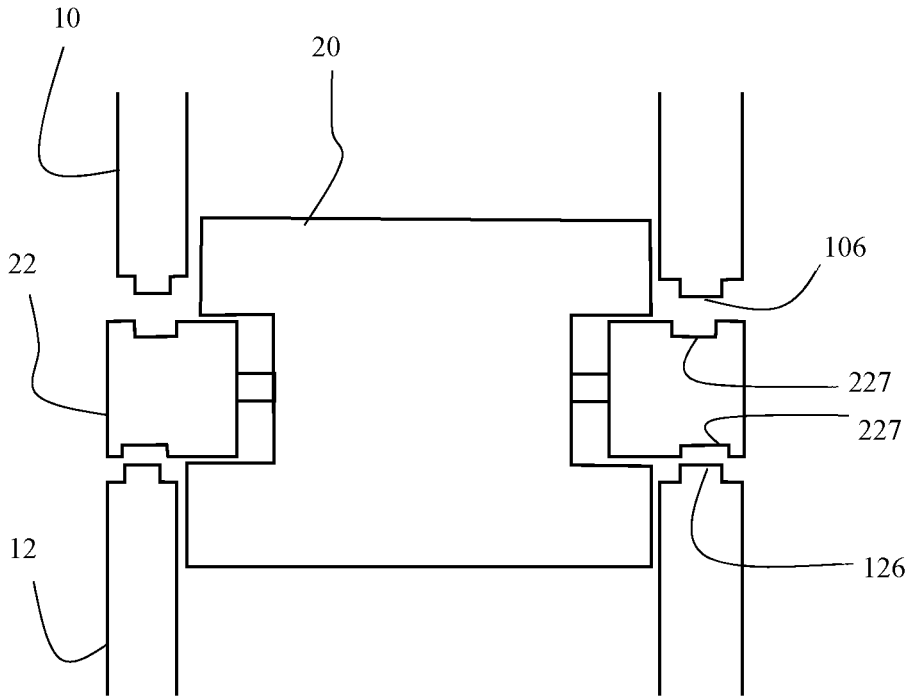
FIG. 8 is a cross sectional view of a portion of a projectile, according to an illustrative embodiment.

FIG. 8 is a cross sectional view of a portion of a projectile, according to an illustrative embodiment. In an alternative embodiments of the invention, varying geometry changes may be introduced. In one such embodiment, the fore portion 10 and aft portion 12 comprise a protruding lip 126. The torque ring 22 further comprises an accompanying intruding cutout. This lip 126 serves to restrict any dilation of the threads under tensile loads attempting to force the joint apart.

Figure 9:
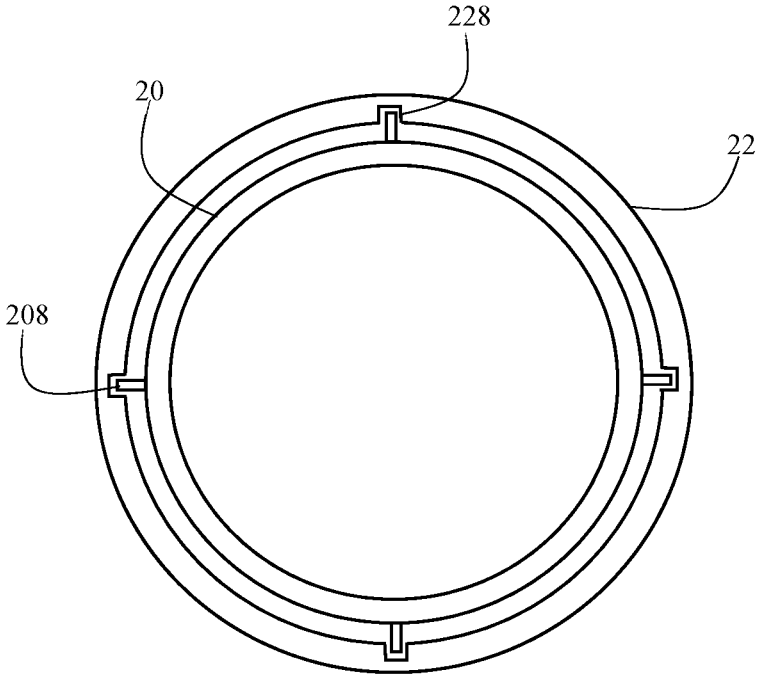
FIG. 9 is a top view of a threaded module, according to an illustrative embodiment.

FIG. 9 is a top view of a threaded module, according to an illustrative embodiment. In another embodiment, the torque pins 208 are integral to the threaded cylinder 20 by means of direct machining or are pre-inserted pressing the pins 208 into the cylinder 20. The torque ring 22 further comprises multiple axial slots 228 machined into the inner surface of the torque ring 22 to create a "gear" shape on the inside that mesh with the torque features 208 on the cylinder 20 and prevent the need to assemble the threaded module 2 prior to final assembly.

Figure 10:
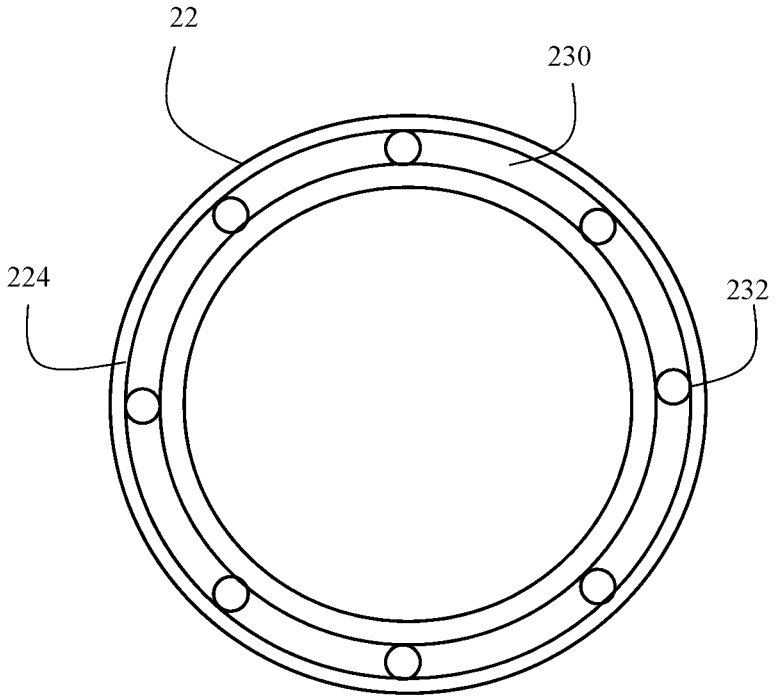
FIG. 10 is a cross-sectional view of the torque ring with a machined groove and ball bearings, according to an illustrative embodiment.

FIG. 10 is a cross-sectional view of the torque ring 22 with a machined groove and ball bearings, according to an illustrative embodiment. In another embodiment, the torque ring 22 comprises a groove 230 machined into the top surface and bottom surface for the addition of ball bearings 232 onto the axial surfaces of this ring, and thereby reduce the friction of these surfaces as it is torqued. The torque may be tuned to a specific preload by utilizing a deformable material such that the ball bearings 232 maintain their shape, but deform the material that they contact at a known stress, after which, friction of the surfaces overcomes the torque applied thereby forming a defined relationship between applied torque and material deformation In another embodiment, the internal threaded cylinder 20 is employed to simply draw the two parts together until they bottom on the torque ring 22, but instead of applying additional torque, the assembly is mounted on a machine that spins the torque ring 22 at a sufficient rate of speed to create a friction weld between the torque ring 22 and the joining pieces. In this embodiment, the pins used to transfer the assembly torque from the torque ring to the threaded cylinder are designed to fail in shear, allowing the torque ring to then be turned at the aforementioned rate of speed while the inner threaded cylinder remains static.

Figure 11:
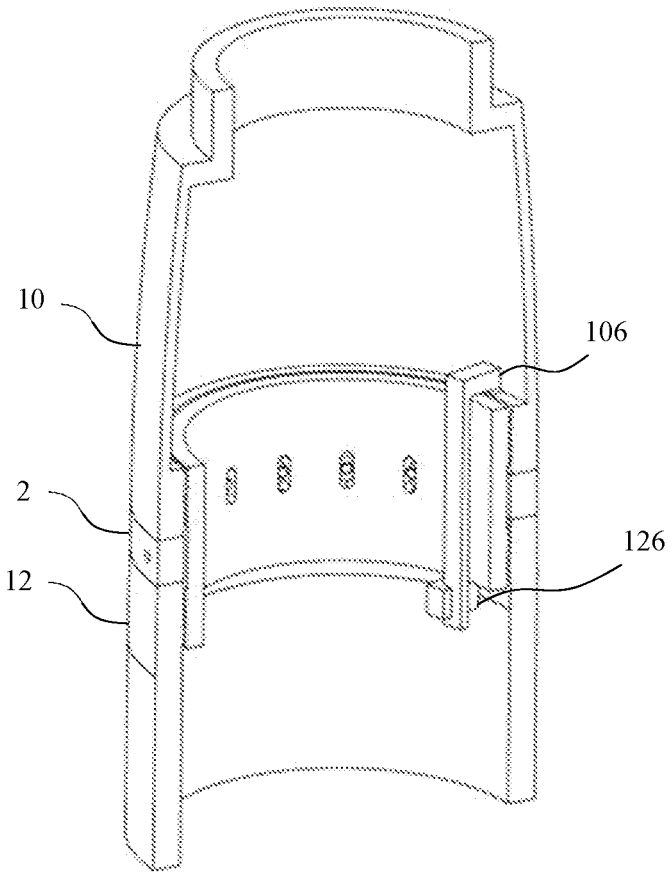
FIG. 11 is a cross-sectional perspective view of a projectile with a threaded module and an angular alignment feature, according to an illustrative embodiment.
Figure 12:
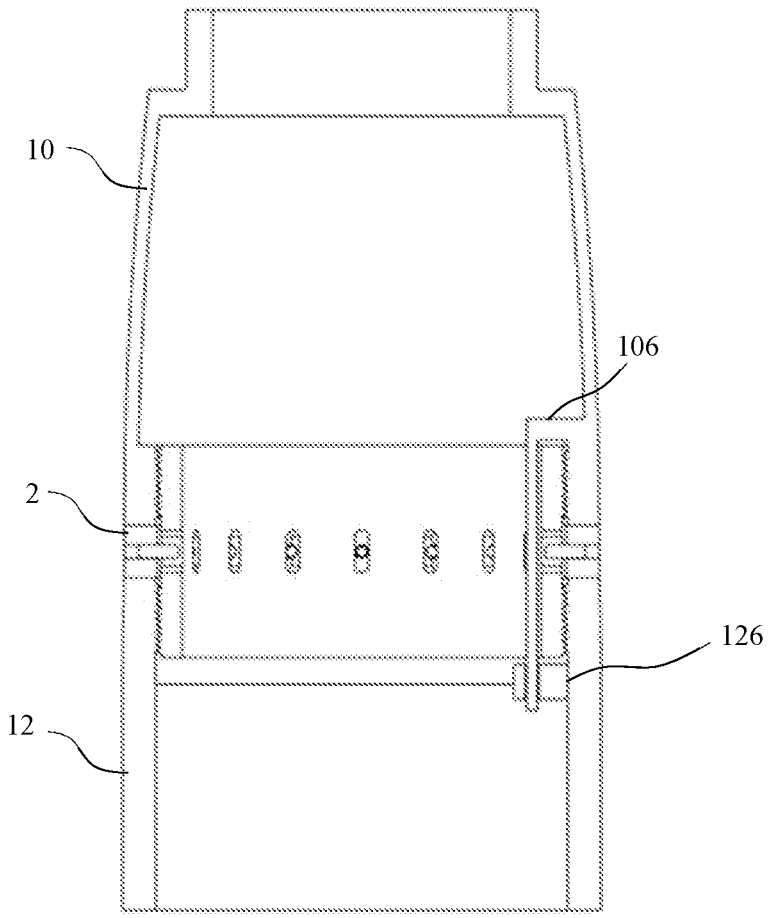
FIG. 12 is a cross-sectional side view of a projectile with a threaded module and an angular alignment feature, according to an illustrative embodiment.
Figure 13:
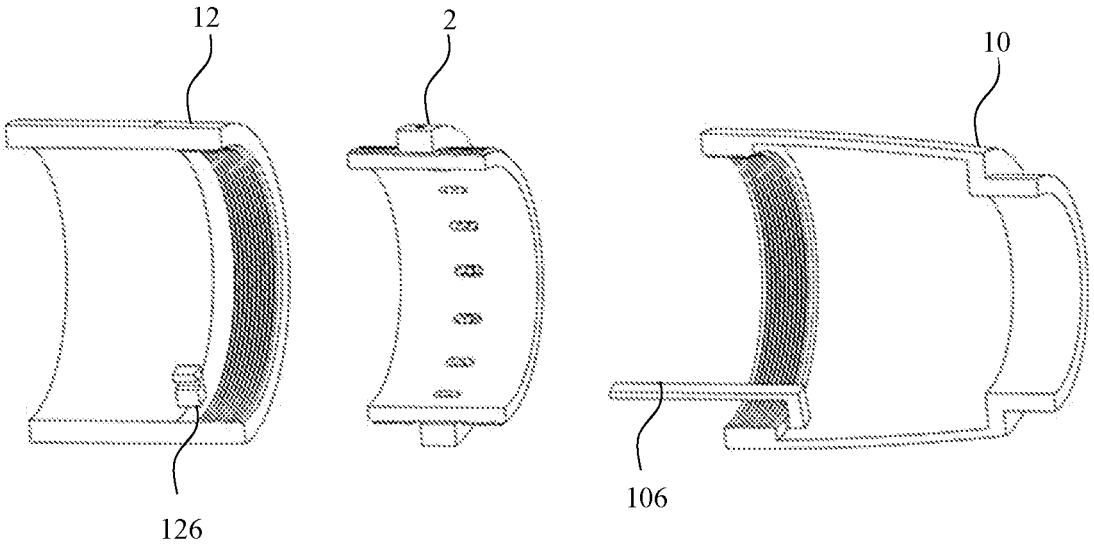
FIG. 13 is a cross-sectional exploded view of a projectile with a threaded module and an angular alignment feature, according to an illustrative embodiment.

FIG. 11 is a cross-sectional perspective view of a projectile with a threaded module and an angular alignment feature, according to an illustrative embodiment. FIG. 12 is a cross-sectional side view of a projectile with a threaded module and an angular alignment feature, according to an illustrative embodiment. FIG. 13 is a cross-sectional exploded view of a projectile with a threaded module and an angular alignment feature, according to an illustrative embodiment. In another embodiment, the projectile includes angular alignment features that span between adjoining parts, inside of the threaded cylinder 20 to allow for articulation of the mechanism without interference.

The fore portion 10 further comprises an L-shape extension which first extends inward from the interior surface of the fore portion 10 and then downward toward the threaded module 2 and aft portion 12. The aft portion 12 further comprises a protrusion with a slot sized and dimensioned to receive the extension. The extension extends inward a distance sufficient such that the protrusion clears the threaded cylinder 20 and does not interfere with the operation of the threaded module 2. The fore portion 10 and the aft portion 12 may be initially angularly aligned with each other by inserting the distal end of the extension in the slot. As the fore portion 10 and aft portion 12 are drawn together, the extension is further drawn into the slot ensuring that the two portions stay aligned during assembly.

Those skilled in the art will recognize that in other embodiments, the position of the angular alignment features may be reversed with the extension extending from the aft portion 12 and the protrusion located on the fore portion 10. In other embodiments, an alternative angular alignment mechanism may be employed as long as it may ensure proper angular alignment of the projectile while not interfering with the function of the threaded module 2.

While the invention has been described with reference to certain embodiments, numerous changes, alterations and modifications to the described embodiments are possible without departing from the spirit and scope of the invention as defined in the appended claims, and equivalents thereof.

What is claimed is:

1. A projectile comprising:

a fore portion having a threaded portion of a first handedness;

an aft portion having a threaded portion of a second handedness; and a threaded module positioned between and connecting the fore portion and the aft portion, said threaded module further comprising a cylinder further comprising a first threaded portion of a first handedness for mating with the fore portion of the projectile and a second threaded portion of a second handedness for mating with the aft portion of the projectile, said first threaded portion and second threaded portion diametrically opposed from each other at opposing ends of the cylinder and one or more radial slots positioned between the first threaded portion and the second threaded portion, a torque ring coaxial with and partially surrounding the cylinder with a top surface of the torque ring in contact with a bottom surface of the fore portion and a bottom surface of the torque ring in contact with a top surface of the aft portion, said torque ring further comprising one or more holes, said one or more holes each corresponding to the one or more radial slots of the cylinder, and one or more torque pins sized and dimensioned to be inserted through the one or more holes and radial slots.

2. The projectile of claim 1 wherein outer mold line formed between the torque ring and the fore portion and the aft portion is uniform in profile.

3. The projectile of claim 1 wherein the radial slots of the cylinder are centered between the first threaded portion and the second threaded portion.

4. The projectile of claim 3 wherein the radial slots allow for torque pins to translate along the principal axis of cylinder during assembly of the projectile.

5. The projectile of claim 1 wherein the fore portion and the aft portion further comprise a lip protruding from an interior circumferential surface and wherein the torque ring further comprises a first cutout and a second cutout which correspond to the lips of the fore section and aft section.

6. The projectile of claim 1 wherein the torque ring further comprises a groove defined by inner circumferential surface of the torque ring for supporting one or more friction reducing elements during assembly.

7. The projectile of claim 6 wherein the friction reducing elements are ball bearings.

8. The projectile of claim 7 wherein the ball bearings contact a deformable material which maintains form until a predetermined stress is reached during assembly, thereby forming a defined relationship between applied torque and material deformation.

9. The projectile of claim 1 further comprising a friction weld between the fore portion and the torque ring and between the aft portion and the torque ring.

10. A method for assembling a projectile comprising the steps of:

providing a fore portion having a threaded portion of a first handedness, an aft portion having a threaded portion of a second handedness, a cylinder further comprising a first threaded portion of a first handedness and a second threaded portion of a second handedness, said first threaded portion and second threaded portion diametrically opposed from each other at opposing ends of the cylinder and one or more radial slots positioned between the first threaded portion and the second threaded portion, a torque ring further comprising one or more holes;

positioning a torque ring around a center portion of a cylinder such that the one or more holes defined by the torque ring are aligned with the one or more radial slots defined by the cylinder;

inserting a torque pin through each of the aligned pairs of holes and radial slots;

simultaneously engaging the first threaded portion of with the fore portion of the projectile and the second threaded portion with the aft portion of the projectile;

rotating the cylinder and torque ring thereby drawing the fore portion and the aft portion together without rotating the fore portion and the aft portion; and bottoming out the fore portion and the aft portion on the torque ring.

11. The method of claim 10 further comprising the step of creating a friction weld between the torque ring and the fore portion and the torque ring and the aft portion.

12. The method of claim 10 wherein the step of rotating the cylinder and torque ring is performed with a spanner.

13. The method of claim 10 wherein the torque ring further comprises a groove defined by inner circumferential surface of the torque ring for supporting one or more ball bearings contact a deformable material and the step of which rotating the cylinder and torque ring further comprises the step of rotating the cylinder and torque ring until a predetermined stress is reached thereby deforming the material in contact.

* * * * *